United States Patent [19]

Houle et al.

[11] Patent Number: 5,066,821

[45] Date of Patent: Nov. 19, 1991

[54] PROCESS FOR PREPARING POSITIVE ELECTROSTATIC LIQUID DEVELOPERS WITH ACIDIFIED CHARGE DIRECTORS

[75] Inventors: William A. Houle, Kimberton; James R. Larson, West Chester, both of Pa.; Kathryn A. Pearlstine, Wilmington, Del.

[73] Assignee: DXImaging, Lionville, Pa.

[21] Appl. No.: 522,283

[22] Filed: May 11, 1990

[51] Int. Cl.[5] ..... G03G 9/06

[52] U.S. Cl. ..... 430/137; 430/115

[58] Field of Search ..... 430/115, 137

[56] References Cited

U.S. PATENT DOCUMENTS

| | | | |
|---|---|---|---|
| 4,845,007 | 7/1989 | Hyosu et al. | 430/137 |
| 4,917,985 | 4/1990 | El-Sazed et al. | 430/115 |
| 4,917,986 | 4/1990 | Chan et al. | 430/115 |

OTHER PUBLICATIONS

U.S. Ser. No. 408,222, 9/89, El-Sayed/Pagel/Pearlstine.

*Primary Examiner*—David Welsh
*Assistant Examiner*—Stephen Rosasco

[57] ABSTRACT

A process for preparing an improved positive-working electrostatic liquid developer comprising (A) dispersing at an elevated temperature in a vessel a thermoplastic resin and a nonpolar liquid having a Kauri-butanol value of less than 30, while maintaining the temperature in the vessel at a temperature sufficient to plasticize and liquify the resin and below that at which the nonpolar liquid degrades and the resin decomposes, (B) cooling the dispersion, either (1) without stirring to form a gel or solid mass, followed by shredding the gel or solid mass and grinding by means of particulate media;

(2) with stirring to form a viscous mixture and grinding by means of particulate media; or (3) while grinding by means of particulate media to prevent the formation of a gel or solid mass;

(C) separating the dispersion of toner particles having an average particle size of less than 30 μm from the particulate media, and (D) adding to the dispersion subsequent to Step (A) a nonpolar liquid soluble ionic or zwitterionic charge director compound mixed with an acid having a pKa of $<4.2$ and a solubility of at least 0.5% based on the weight of charge director compound in the mixture of nonpolar liquid and charge director compound. Optionally a colorant and an adjuvant may be added. The electrostatic liquid developer prepared using the process of the invention is useful in copying, making proofs, including digital color proofs; lithographic printing plates, and resists.

30 Claims, No Drawings

PROCESS FOR PREPARING POSITIVE ELECTROSTATIC LIQUID DEVELOPERS WITH ACIDIFIED CHARGE DIRECTORS

DESCRIPTION

TECHNICAL FIELD

This invention relates to a process for the preparation of positive-charged electrostatic liquid developers. More particularly this invention relates to a process for the preparation of positive-charged electrostatic liquid developers containing a charge director compound mixed with an acid having a pKa of <4.2 and a solubility of at least 0.5% based on the weight of charge director compound in the mixture of nonpolar liquid and charge director compound.

BACKGROUND ART

It is known that a latent electrostatic image can be developed with toner particles dispersed in a carrier liquid, generally an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0, and a high vapor pressure. The toner particles are less than 10 μm average by area size. After the latent electrostatic image has been formed, the image is developed by the colored toner particles dispersed in said nonpolar liquid and the image may subsequently be transferred to a carrier sheet.

Since the formation of proper images depends on the differences of the charge between the liquid developer and the latent electrostatic image to be developed, it has been found desirable to add a charge director compound and preferably adjuvants, e.g., polyhydroxy compounds, polybutylene succinimide, an aromatic hydrocarbon, etc. to the liquid developer comprising the thermoplastic resin, nonpolar liquid, and preferably a colorant. Such liquid developers provide images of good resolution, but it has been found that charging and image quality are particularly pigment dependent. Some formulations suffer from low or poorly controlled particle mobility resulting in poor image quality manifested by low resolution, poor solid area coverage, and/or image squash. Furthermore, some formulations result in wrong sign (negative) developers. In order to overcome such problems much research effort has been expended to develop new type charge directors and/or charging adjuvant for electrostatic liquid developers.

It has been found that the above disadvantages can be overcome and improved positive developers prepared as described below containing a nonpolar liquid, a thermoplastic resin, a charge director compound mixture described below, and preferably a colorant. The improved positive electrostatic liquid developer charged with the charge director compound mixture when used to develop an electrostatic image results in image quality, squash, and solid area coverage comparable to other known charge directors with the additional advantage that for a given liquid developer the charge director compound mixture can be controlled to optimize liquid developer performance.

SUMMARY OF THE INVENTION

In accordance with this invention there is provided a process for preparing a positive electrostatic liquid developer comprising (A) dispersing at an elevated temperature in a vessel a thermoplastic resin and a nonpolar liquid having a Kauri-butanol value of less than 30, while maintaining the temperature in the vessel at a temperature sufficient to plasticize and liquify the resin and below that at which the nonpolar liquid degrades and the resin decomposes, (B) cooling the dispersion, either (1) without stirring to form a gel or solid mass, followed by shredding the gel or solid mass and grinding by means of particulate media;

(2) with stirring to form a viscous mixture and grinding by means of particulate media; or (3) while grinding by means of particulate media to prevent the formation of a gel or solid mass;

(C) separating the dispersion of toner particles having an average by area particle size of less than 10 μm from the particulate media, and (D) adding to the dispersion subsequent to Step (A) a nonpolar liquid soluble ionic or zwitterionic charge director compound mixed with an acid having a pKa of <4.2 and a solubility of at least 0.5% based on the weight of charge director compound in the mixture of nonpolar liquid and charge director compound.

DETAILED DESCRIPTION OF THE INVENTION

The process of this invention results in toner particles adapted for electrophoretic movement through a hydrocarbon liquid, generally a nonpolar liquid.

The toner particles are prepared from at least one thermoplastic polymer or resin, charge director compound mixtures, and hydrocarbon liquids as described in more detail below. Additional components can be added, e.g., colorants, adjuvants, polyethylene, fine particle size oxides, such as silica, etc.

In carrying out the process of the invention, a suitable mixing or blending vessel, e.g., attritor, heated ball mill, heated vibratory mill such as a Sweco Mill manufactured by Sweco Co., Los Angeles, Calif., equipped with particulate media, for dispersing and grinding, Ross double planetary mixer manufactured by Charles Ross and Son, Hauppauge, N.Y., etc., or a two roll heated mill (no particulate media necessary) are placed at least one of thermoplastic resin, and liquid, preferably nonpolar liquids, described below. Generally the resin, nonpolar liquid and optional colorant are placed in the vessel prior to starting the dispersing step. Optionally the colorant can be added after homogenizing the resin and the nonpolar liquid. Polar liquid similar to that described in Mitchell, U.S. Pat. No. 4,631,244, can also be present in the vessel, e.g., up to 100% based on the weight of total developer liquid. The dispersing step is generally accomplished at elevated temperature, i.e., the temperature of ingredients in the vessel being sufficient to plasticize and liquefy the resin but being below that at which the nonpolar liquid or polar liquid, if present, degrades and the resin and/or colorant, if present, decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc., selected from the group consisting of stainless steel, carbon steel, alumina, ceramic, zirconia, silica, and sillimanite. Carbon steel particulate media is particularly useful when colorants other than black are used. A typical diameter range for the particulate media is in the range of 0.04 to 0.5 inch (1.0 to approx. 13 mm).

After dispersing the ingredients in the vessel, with or without a polar liquid present, until the desired dispersion is achieved, typically one hour with the mixture being fluid, the dispersion is cooled, e.g., in the range of 0° C. to 50° C. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding, e.g., by means of particulate media with or without the presence of additional liquid; or with stirring to form a viscous mixture and grinding by means of particulate media with or without the presence of additional liquid. Additional liquid may be added at any step during the preparation of the liquid electrostatic developers to facilitate grinding or to dilute the developer to the appropriate % solids needed for toning. Additional liquid means nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size (by area) of less than 10 μm, as determined by a Horiba CAPA-500 centrifugal particle analyzer described above or other comparable apparatus, are formed by grinding for a relatively short period of time.

Another instrument for measuring average particles sizes is a Malvern 3600E Particle Sizer manufactured by Malvern, Southborough, Mass. which uses laser diffraction light scattering of stirred samples to determine average particle sizes. Since these two instrument use different techniques to measure average particle size the readings differ. The following correlation of the average size of toner particles in micrometers (μm) for the two instruments is:

| Value Determined By Malvern 3600E Particle Sizer | Expected Range For Horiba CAPA-500 |
|---|---|
| 30 | 9.9 ± 3.4 |
| 20 | 6.4 ± 1.9 |
| 15 | 4.6 ± 1.3 |
| 10 | 2.8 ± 0.8 |
| 5 | 1.0 ± 0.5 |
| 3 | 0.2 ± 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification the average particle size values are as measured using the Malvern instrument.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional nonpolar liquid as described previously above. The dilution is normally conducted to reduce the concentration of toner particles to between 0.1 to 15 percent by weight, preferably 0.3 to 3.0, and more preferably 0.5 to 2 weight percent, with respect to the nonpolar liquid. A nonpolar liquid soluble ionic or zwitterionic charge director compound, of the type set out below, can be added to impart a charge to the liquid electrostatic developer. The addition of the charge director compound admixed with the acid may occur at any time during the process subsequent to Step (A); preferably at the end of the process, e.g., after the particulate media, if used, are removed and the dilution of toner particles is accomplished. By mix or admixed is meant that the charge director and the acid can be added together or individually to the liquid developer in either order. If a diluting nonpolar liquid is also added, the charge director compound admixed with the acid can be added prior to, concurrently with, or subsequent thereto. If an adjuvant compound of a type described below has not been previously added in the preparation of the developer, it can be added prior to or subsequent to the developer being charged.

The nonpolar liquids are, preferably, branched-chain aliphatic hydrocarbons and more particularly, Isopar ®-G, Isopar ®-H, Isopar ®-K, Isopar ®-L, Isopar ®-M and Isopar ®-V. These hydrocarbon liquids are narrow cuts of isoparaffinic hydrocarbon fractions with extremely high levels of purity. For example, the boiling range of Isopar ®-G is between 157° C. and 176° C., Isopar ®-H between 176° C. and 191° C., Isopar ®-K between 177° C. and 197° C., Isopar ®-L between 188° C. and 206° C. and Isopar ®-M between 207° C. and 254° C. and Isopar ®-V between 254.4° C. and 329.4° C. Isopar ®-L has a mid-boiling point of approximately 194° C. Isopar ®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar ®12, Norpar ®13 and Norpar ®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar ® 12 | 69 | 204 |

-continued

| Liquid | Flash Point (°C.) | Auto-Ignition Temp (°C.) |
|---|---|---|
| Norpar ® 13 | 93 | 210 |
| Norpar ® 15 | 118 | 210 |

All of the nonpolar liquids have an electrical volume resistivity in excess of $10^9$ ohm centimeters and a dielectric constant below 3.0. The vapor pressures at 25° C. are less than 10 Torr. Isopar®-G has a flash point, determined by the tag closed cup method, of 40° C., Isopar®-H has a flash point of 53° C. determined by ASTM D 56. Isopar®-L and Isopar®-M have flash points of 61° C., and 80° C., respectively, determined by the same method. While these are the preferred nonpolar liquids, the essential characteristics of all suitable nonpolar liquids are the electrical volume resistivity and the dielectric constant. In addition, a feature of the nonpolar liquids is a low Kauri-butanol value less than 30, preferably in the vicinity of 27 or 28, determined by ASTM D 1133. The ratio of thermoplastic resin to nonpolar liquid is such that the combination of ingredients becomes fluid at the working temperature. The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 3.0% by weight. The total weight of solids in the liquid developer is solely based on the resin, including components dispersed therein, and any pigment component present.

Useful thermoplastic resins or polymers include: ethylene vinyl acetate (EVA) copolymers (Elvax® resins, E. I. du Pont de Nemours and Company, Wilmington, Del.), copolymers of ethylene and an $\alpha,\beta$-ethylenically unsaturated acid selected from the group consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite® DPD 6169, DPDA 6182 Natural and DTDA 9169 Natural by Union Carbide Corp., Stamford, Conn.; ethylene vinyl acetate resins, e.g., DQDA 6479 Natural and DQDA 6832 Natural 7 also sold by Union Carbide Corp.; Surlyn® ionomer resin by E. I. du Pont de Nemours and Company, Wilmington, Del., etc., or blends thereof, polyesters, polyvinyl toluene, polyamides, styrene/butadiene copolymers and epoxy resins. The synthesis of copolymers of ethylene and an $\alpha,\beta$-ethylenically unsaturated acid of either acrylic acid or methacrylic is described in Rees U.S. Pat. No. 3,264,272, the disclosure of which is incorporated herein by reference. For the purposes of preparing these copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A. Particularly preferred copolymers of this type have an acid number of 66 and 54 and a melt index of 100 and 500 determined at 190° C., respectively.

Preferred thermoplastic resins include acrylic resins, such as a copolymer of acrylic or methacrylic acid (optional but preferred) and at least one alkyl ester of acrylic or methacrylic acid wherein alkyl is 1 to 20 carbon atoms, e.g., methyl methacrylate(50 to 90%)/methacrylic acid(0 to 20%)/ethylhexyl acrylate(10 to 50%); and other acrylic resins including Elvacite® Acrylic Resins, E. I. du Pont de Nemours and Company, Wilmington, DE, or blends of the resins, polystyrene, polyethylene, and modified resins disclosed in El-Sayed et al. U.S. Pat. No. 4,798,778, the disclosure of which is incorporated herein by reference.

In addition, the resins have the following preferred characteristics:

1. Be able to disperse the colorant, e.g., pigment, etc.
2. Be substantially insoluble in the liquid at temperatures below 40° C., so that the resin will not dissolve or solvate in storage,
3. Be able to solvate at temperatures above 50° C.,
4. Be able to be ground to form particles between 0.1 μm and 5 μm, in diameter (preferred size), e.g., determined by Horiba CAPA-500 centrifugal particle analyzer; and between 1 μm and 15 μm in diameter, e.g., determined by Malvern 3600E, which uses laser diffraction light scattering of stirred samples to determine average particle sizes.

5 Be able to form a particle (average by area) of less than 10 μm, e.g., determined by Horiba CAPA-500 centrifugal automatic particle analyzer, manufactured by Horiba Instruments, Inc., Irvine, Calif.: solvent viscosity of 1.24 cps, solvent density of 0.76 g/cc, sample density of 1.32 using a centrifugal rotation of 1,000 rpm, a particle size range of 0.01 to less than 10 μ, and =particle size cut of 1.0 μm, and about 30 μm average particle size, e.g., determined by Malvern 3600E Particle Sizer as described above, and 6. Be able to fuse at temperatures in excess of 70° C. By solvation in 3 above, the resins forming the toner particles will become swollen, gelatinous or softened.

Suitable nonpolar liquid soluble ionic or zwitterionic charge director compounds, which are generally used in an amount of 0.25 to 1500 mg/g, preferably 2.5 to 400 mg/g developer solids, include: lecithin, Calcium Petronate®, Neutral or Basic Barium Petronate® oil-soluble petroleum sulfonate, manufactured by Sonneborn Division of Witco Corp., New York, N.Y., alkyl succinimide (manufactured by Chevron Chemical Company of California), anionic glycerides such as Emphos® D70-30C, Emphos® F27-85, etc. manufactured by Witco Corp., New York, N.Y., metallic soaps, e.g., aluminum tristearate; aluminum distearate; barium, calcium, lead and zinc stearates; cobalt, manganese, lead and zinc linoleates; aluminum, calcium, cobalt octoates; calcium and cobalt oleates; zinc palmitate; calcium, cobalt, manganese, lead and zinc naphthenates; calcium, cobalt, manganese, lead and zinc resinates, etc.

The acid that is mixed with the nonpolar liquid soluble ionic or zwitterionic charge director compound has a pKa of <4.2, and preferably <3.5, and a solubility of at least 0.5% based on the weight of charge director compound in the mixture of nonpolar liquid and charge director compound. The acid may be selected from the group consisting of (1) inorganic acid compounds of the general formula:

$H_xY$ where x is an integer from 1–4 and is equal to the negative charges on the anion, Y is a moiety selected from the group consisting of $Cl^-$, $F^-$, $NO_3^-$, $NO_2^-$, $PO_4^{-3}$, $SO_4^{-2}$, $SO_3^{-2}$, $ClO_4^-$, and $IO_4^-$;

(2) organic acid compounds of the general formulas:

$$R—NH—SO_3H \quad (i)$$

$$R—SO_3H \quad (ii)$$

$$R—PO_3H_2 \quad (iii)$$

where R is alkyl of 1 to 30 carbon atoms, aryl of 6 to 30 carbon atoms, substituted alkyl of 1 to 30 carbon atoms, e.g., halide, e.g., F, Cl, Br, I; hydroxy, nitro, carbonyl, carboxyl, alkyl, aryl cyano, etc., or substituted aryl of 6 to 30 carbon atoms, e.g., substituents as described above for alkyl, and (3) substituted carboxylic acid compounds of the general formula $$X_y—R—CO_2H$$

where R is alkyl of 1 to 500 carbon atoms, aryl of 6 to 30 carbon atoms, and alkylaryl of 7 to 40 carbon atoms;

X is selected from the group consisting of (1) an electron withdrawing group selected from the group consisting of CHO, CN, Cl, Br, I, F, $CF_3$, $CO_2H$, $COR^1$, $CO_2R^1$, $N(R^1)_3+$, $SO_2R^1$, $CONR_2^1$, $CONH_2$, $CONHR^1$, $SO_2OR^1$, $NO_2$ wherein $R^1$ is alkyl of 1 to 40 carbon atoms, aryl of 6 to 30 carbon atoms and alkylaryl of 6 to 30 carbon atoms at least one electron withdrawing group being located no further than 5 carbon atoms from the carbonyl carbon of the acid group;

(2) a carboxylate anion-stabilizing moiety attached to the carbon atom adjacent to the carbonyl carbon of the acid group when R is alkyl, e.g., OH, SH, $SR^1$, wherein $R^1$ is alkyl of 1 to 40 carbon atoms, aryl of 6 to 30 carbon atoms, and alkylaryl of 6 to 30 carbon atoms; and (3) a carboxylate anion-stabilizing moiety attached to the carbon atom ortho to the carbon atom attached to the carbonyl carbon of the acid group when R is aryl, e.g., OH, SH, $SR^1$, wherein $R^1$ is alkyl of 1 to 40 carbon atoms, aryl of 6 to 30 carbon atoms, and alkylaryl of 6 to 30 carbon atoms; and combinations of (1), (2) and (3); and y is an integer of 1 to 20.

Examples of useful acid compounds include hydrochloric acid, hydrofluoric acid, nitric acid, nitrous acid, perchloric acid, periodic acid, phosphoric acid, sulfuric acid, sulfurous acid, chloroacetic acid, dichloroacetic acid, trichloroacetic acid, fluoroacetic acid, difluoroacetic acid, trifluoroacetic acid, hydroxyphenylacetic acid, 4-chlorobutyric acid, 3-chloropropionic acid, n-propyldicarboxylic acid, 3-cyanopropionic acid, poly(ethyhexyl methacrylate-co-methacrylic acid), p-nitrobenzoic acid, m-nitrobenzoic acid, p-chlorobenzoic acid, m-chlorobenzoic acid, 4-chloro-1-naphthonic acid, pentadecylsalicylic acid, 2-chloro-4-methylbenzoic acid, o-hydroxybenzoic acid, alpha-hydroxyacetic acid, toluenesulfonic acid, dinonylnaphthalenesulfonic acid, 1-naphthalenesulfonic acid, 2-naphthalenesulfonic acid, benzenesulfonic acid, 4-ethylbenzenesulfonic acid, 1-butylsulfonic acid, 1-dodecylsulfonic acid, 1-octadecylsulfonic acid, 10-camphorsulfonic acid, 4-chlorobenzenesulfonic acid, dodecylbenzenesulfonic acid, 1-pyrenesulfonic acid, 5-sulfosalicylic acid, 2,5-xylenesulfonic acid, 1-butylsulfamic acid, cyclohexylsulfamic acid, 1-hexylsulfamic acid, 1-octylsulfamic acid, 1-decylsulfamic acid, 1-dodecylsulfamic acid, 1-pentylphosphonic acid, benzylphosphonic acid, n-butylphosphonic acid, s-butylphosphonic acid, t-butylphosphonic, di-n-butylphosphonic acid, di-n-docylphosphonic acid, n-decylphosphonic acid, diphenylphosphonic acid, dodecylphosphonic acid.

The preferred acids are dodecylphosphonic acid, p-nitrobenzoic acid, p-toluenesulfonic acid, dichloroacetic acid, dinonylnaphthalenesulfonic acid, butylsulfonic acid, butylsulfamic acid, ethyl benzenesulfonic acid, hydrochloric acid, sulfuric acid, nitric acid, phosphoric acid, cyclohexylsulfamic acid, 10-camphorsulfonic acid. The most preferred acids are butylsulfonic acid, sulfuric acid, dichloroacetic acid, and p-nitrobenzoic acid.

As indicated above, additional components that can be present in the electrostatic liquid developer are colorants, such as pigments or dyes and combinations thereof, which are preferably present to render the latent image visible, though this need not be done in some applications. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigments include:

Pigment List

| Pigment Brand Name | Manufacturer | Colour Index Pigment |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow YT-858-D | Heubach | Yellow 74 |
| Hansa Yellow X | Hoechst | Yellow 75 |
| Novoperm ® Yellow HR | Hoechst | Yellow 83 |
| Chromophtal ® Yellow 3G | Ciba-Geigy | Yellow 93 |
| Chromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Chromophtal ® Yellow 8G | Ciba-Geigy | Yellow 128 |
| Irgazin ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | Yellow 14 |
| L75-1331 Yellow | Sun Chem. | Yellow 17 |
| L75-2337 Yellow | Sun Chem. | Yellow 83 |
| Hostaperm ® Orange GR | Hoechst | Orange 43 |
| Paliogen ® Orange | BASF | Orange 51 |
| Irgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue NBD 7010 | BASF | Blue:3 |
| Heliogen ® Blue K 7090 | BASF | Blue 15:3 |
| Heliogen ® Blue L 7101F | BASF | Blue 15:4 |
| Paliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |

-continued

Pigment List

| Pigment Brand Name | Manufacturer | Colour Index Pigment |
|---|---|---|
| Quindo ® Red R6700 | Mobay | Violet 19 |
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | White 6 |
| Mogul L | Cabot | Black, CI 77266 |
| Uhlich ® BK 8200 | Paul Uhlich | Black (Blackness Index 155) |

Other ingredients may be added to the electrostatic liquid developer, such as fine particle size oxides, e.g.-,silica, alumina, titania, etc.; preferably in the order of 0.5 μm or less can e dispersed into the liquefied resin. These oxides can be used alone or in combination with the colorant. Metal particles can also be added.

Another additional component of the electrostatic liquid developer is an adjuvant which can be selected from the group consisting of polyhydroxy compound which contains at least 2 hydroxy groups, aminoalcohol, polybutylene succinimide, and aromatic hydrocarbon having a Kauributanol value of greater than 30. The adjuvants are generally used in an amount of 1 to 1000 mg/g, preferably 1 to 200 mg/g developer solids. Examples of the various above-described adjuvants include:

polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxystearate, etc., as described in Mitchell U.S. Pat. No. 4,734,352.

polybutylenesuccinimide: OLOA ®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc. These adjuvants are described in El-Sayed and Taggi U.S. Pat. No. 4,702,984.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of $C_9$ and $C_{10}$ alkyl-substituted benzenes manufactured by Exxon Corp., etc., as described in Mitchell U.S. Pat. No. 4,631,244.

The disclosures of the above-listed United States patents describing the adjuvants are incorporated herein by reference.

The particles in the electrostatic liquid developer have an average particle size of 10 μm or less. The average particle size determined by the Malvern 3600E Particle Size Analyzer can vary depending on the use of the liquid developer. The resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

INDUSTRIAL APPLICABILITY

The electrostatic liquid developers prepared according to the invention demonstrate good image quality, resolution, solid area coverage, and toning of fine details, evenness of toning, reduced squash independent of the pigment present. The developers of this invention are useful in copying, e.g., making office copies of black and white as well as various colors; or color proofing, e.g., a reproduction of an image using the standard colors: yellow, cyan, magenta together with black as desired. In copying and proofing the liquid developer is applied to a latent electrostatic image. Other uses envisioned for the electrostatic liquid developers include: digital color proofing, lithographic printing plates, and resists.

EXAMPLES

The following controls and examples wherein the parts and percentages are by weight illustrate but do not limit the invention. In the examples the melt indices were determined by ASTM D 1238, Procedure A, the average particle sizes were determined by a Malvern Particle sizer as described above, the conductivity was measured in picomhos/cm (pmhos) at 5 hertz and low voltage, 5 volts, and the density was measured using a MacBeth densitometer model RD918. The resolution is expressed in the examples in line pairs/mm (lp/mm). Weight average molecular weight can be determined by gel permeation chromatography (GPC). Number average molecular weight can be determined by known osmometry techniques.

CONTROL 1

A cyan developer was prepared by adding 337.5 g of a copolymer of ethylene (91%) and methacrylic acid (9%), melt index at 190° C. is 500, acid No. is 54, 37.5 grams of Heucophthal Blue G XBT 583D pigment, Heubach Inc., Newark, N.J.), and 761 g of Isopar ®-L (Exxon Corp.) to a Union Process 1S Attritor, Union Process Company, Akron, Ohio charged with 0.1875 inch (4.76 mm) diameter carbon steel balls. The mixture was milled at 100° C. for one hour then cooled to ambient temperature and the mixture was milled for 6 hours. The average particle size was 9.7 μm. The developer was diluted and charged as follows: 1500 g of 1.5% solids developer were charged with 18.0 g of 10% Emphos ® D70-30C (Witco Corporation, New York, N.Y.). The ESA mobility of this toner was determined to be +1.7 ($X10^{10}m^2/Vs$) with a conductivity of 14 pmhos/cm.

EXAMPLE 1

The procedure of Control 1 was followed. In addition, 0.25 g of dodecylphosphonic acid in 0.75 g n-butanol was added to this developer. The acidified developer had an ESA mobility of +5.0 ($X10^{10}m^2/Vs$) with a conductivity of 12 pmhos/cm. Increased mobility is one of the primary factors in improving developer performance.

CONTROL 2

A cyan developer was prepared by adding 300 g of a copolymer of ethylene (91%) and methacrylic acid (9%), melt index at 190° C. is 500, acid No. is 54, 32 g of Heucophthal Blue G XBT 583D pigment, and 776 g of Isopar ®-L to a Union Process 1S Attritor, Union Process Company, Akron, Ohio charged with 0.1875 inch (4.76 mm) diameter carbon steel balls. The mixture was milled at 100° C. for 1.5 hours then cooled to ambient temperature and the mixture was milled for 3 hours. The average particle size was 5.3 μm. The developer was diluted and charged as follows: 1500 g of 1.0% solids developer was charged with 7.5 g of 10% Basic Barium Petronate ® (Witco Corporation, New York, N.Y.). Image quality was determined using a Savin 2200 Office copier paper or Plainwell Offset Enamel paper, number 3 class, 60 pound test and a Savin 870 copier at standard mode: charging corona at 6.8 Kv and transfer corona set at 8.0 Kv. The images formed demonstrated that this control is a negative toner.

EXAMPLE 2

A developer was prepared as described in Control 2 with the following exception: 0.5 g of 4-hydroxyphenylacetic acid (98%) (Aldrich) was added to the charged developer. Image quality was determined as described in Control 2. The background area imaged, which demonstrates a positive toner.

CONTROL 3

A black toner was prepared by adding 319 g of Elvacite ® 2014, a methacrylate copolymer (E. I. du Pont de Nemours and Co., Wilmington, Del.), 106 g of Uhlich BK 8200 carbon black pigment (Paul Uhlich and Co., Hastings-On-Hudson, N.Y.), and 1700 g of Isopar ®-L to a Union Process 1S Attritor, Union Process Company, Akron, OH charged with 0.1875 inch (4.76 mm) diameter carbon steel balls. The mixture was milled at 100° C. for one hour then cooled to ambient temperature and the mixture was milled for 2 hours. The particle size was 10.8 μm. The developer was diluted and charged as follows: 1400 g of 1.0% solids developer were charged with 5.25 g of 10% charge director compound indicated in Table 1 below. Image quality was determined using the Savin 870 copier with Plainwell Offset Enamel paper described in Control 2 under positive toner test conditions: charging corona set at +6.8 Kv, development bias set at +650 volts and transfer corona set at −6.6 Kv, reversal image target (black areas on target image with negative toner, white areas on target image with positive toner, gray areas are background). Results are found in Table 1 below.

EXAMPLE 3

Developers were prepared as described in Control 3, except that acidified charge directors were used. Acidified charge directors were prepared using the following procedure: Acidified Emphos ® was prepared by adding 119 g of 10% Emphos ® D70-30C and 1.2 g of p-nitrobenzoic acid (Aldrich, 99%) to a Union Process 01 Attritor, Union Process Company, Akron, Ohio charged with 0.1875 inch (4.76 mm) diameter carbon steel balls. The mixture was milled at 100° C. for one hour then cooled to ambient temperature and the mixture was milled for 24 hours. The unincorporated acid was separated from the acidified charge director by decantation. Emphos ® D70-30C acidified with p-toluenesulfonic acid (Aldrich, 99%) and and Neutral Barium Petronate ® (NBP) acidified with p-nitrobenzoic acid (Aldrich, 99%) were prepared using the same procedure. Results are given in Table 1 below.

TABLE I

| CHARGE DIRECTOR | ACID | COND. (pmho/cm) | MOBILITY ($\times 10^{10}$ $m^2/Vs$) | DENSITY | RESOLUTION (lp/mm) |
|---|---|---|---|---|---|
| Emphos ® D70-30C (control) | NONE | 7 | 5.6 | 0.6 | 3.5 |
| NBP (control) | NONE | 12 | 6.4 | 0.4 | 4.3 |
| Emphos ® D70-30C | pNBA | 5 | 8.3 | 0.8 | 3.5 |
| Emphos ® D70-30C | pTSA | 5 | 9.8 | 0.7 | 4.3 |
| NBP | pNBA | 11 | 12.0 | 0.3 | 8.5 |

CONTROL 4

A cyan developer was prepared by adding 257 g of a copolymer of ethylene (91%) and methacrylic acid (9%), melt index at 190° C. is 500, acid No. is 54, 64.2 g of NBD 7010 cyan pigment (BASF, Holland, Mich.), and 1284 g of Isopar ®-L to a Union Process 1S Attritor, Union Process Company, Akron, Ohio charged with 0.1875 inch (4.76 mm) diameter carbon steel balls. The mixture was milled at 100° C. for one hour then cooled to ambient temperature and an additional 535 g of Isopar ®-L was added and the mixture was milled for 2 hours. The particle size was 7.8 μm. The developer was diluted and charged as follows: 1500 g of 1% solids developer were charged with 7.5 g of 10% Neutral Barium Petronate ®.

Image quality was determined using Savin 870 with Plainwell Offset Enamel paper described in Control 2 under positive toner test conditions: charging corona set at +6.8 Kv, development bias set at +650 volts, and transfer corona set at −6.6 Kv, Reversal Image Target (black areas on target image with negative toner, white areas on target image with positive toner, gray areas are background.) Results are found in Table 2 below.

EXAMPLE 4

A cyan developer was prepared as described in Control 4 except that the 10% Neutral Barium Petronate ® contained 0.5% dichloroacetic acid (DCAA) (Aldrich, 99%). The acidified charge director was prepared by adding the DCAA with gentle mixing. The developer was evaluated as described in Control 4 and results are given in Table 2 below.

TABLE II

| ADDITIVE | COND. (pmho/cm) | PAPER | DENSITY | RES. (lp/mm) | TRANSFER EFFICIENCY |
|---|---|---|---|---|---|
| NONE | 10 | Savin | 1.2 | 6 | 84% |
| (control) | | Offset | 2.1 | 6 | 100% |
| DCAA | 11 | Savin | 1.6 | 7 | 91% |
| | | Offset | 2.7 | 6 | 100% |

CONTROL 5

A black toner was prepared by adding 308 g of Elvacite®2014, 106 g of Uhlich BK8200 carbon black pigment, 10.6 g p-nitrobenzoic acid (Aldrich, 99%), and 1700 grams of Isopar®-L to a Union Process 1S Attritor, Union Process Company, Akron, Ohio charged with 0.1875 inch (4.76 mm) diameter carbon steel balls. The mixture was milled at 100° C. for one hour then cooled to ambient temperature and the mixture was milled for two hours. The particle size was 10.2 μm. The developer was diluted and charged as follows: 1500 g of 1.5% solids developer was charged with 25 g of 10% Emphos® D70-30C. Image quality was determined using Savin 870 with Plainwell Offset Enamel paper as described in Control 2 under positive toner test conditions: charging corona set at +6.8 Kv, development bias set at +650 volts, and transfer corona set at −6.6 Kv, Reversal Image Target (black areas on target image with negative toner, white areas on target image with positive toner, gray areas are background). Results are found in Table 3 below.

EXAMPLE 5

A black developer was prepared by adding 340 g of Elvacite®2014, 85 g of Uhlich BK8200 carbon black pigment, and 1700 g of Isopar®-L to a Union Process 1S Attritor, Union Process Company, Akron, Ohio charged with 0.1875 inch (4.76 mm) diameter carbon steel balls. The mixture was milled at 100° C. for one hour then cooled to ambient temperature and the mixture was milled for 7 hours. The particle size was 8.0 μm. The developer was diluted and charged as follows: 1500 g of 1.5% solids developer were charged with 25 g of 10% Emphos® D70-30C mixed with p-nitrobenzoic acid as described in Example 3. Image quality was determined using Savin 870 with Offset paper under positive toner test conditions: charging corona set at +6.8 Kv, development bias set at +650 volts, and transfer corona set at −6.6 Kv, Reversal Image Target (black areas on target image with negative toner, white areas on target image with positive toner, gray areas are background). Results are found in Table 3 below.

TABLE III

| ADDITIVE | COND. (pmho/cm) | MOBILITY ($\times 10^{10}$ m$^2$/Vs) | PAPER | DENS. | RES. (lp/mm) | TRANS. EFF. |
|---|---|---|---|---|---|---|
| Control 5 | 44 | 5.0 | Savin | .2 | 10 | 24% |
| | | | Offset | .4 | 10 | 68% |
| Example 5 | 40 | 7.6 | Savin | .4 | 10 | 52% |
| | | | Offset | .8 | 10 | 85% |

CONTROL 6

A cyan developer (Sample 1) was prepared by adding 288.9 g of a copolymer of ethylene (91%) and methacrylic acid (9%), melt index at 190° C. is 500, acid No. is 54, 32.1 g of NBD 7010 (BASF, Holland, Mich.) cyan pigment, and 1284 g of Isopar®-L to a Union Process 1S Attritor, Union Process Company, Akron, Ohio charged with 0.1875 inch (4.76 mm) diameter carbon steel balls. The mixture was milled at 100° C. for one hour then cooled to ambient temperature and an additional 535 grams of Isopar®-L was added and the mixture was milled for two hours. The developer was diluted and charged as follows: 1500 g of 1% solids developer were charged with 12.0 g of 10% Emphos® D70-30C which gave a concentration of Emphos® to developer solids of 80 mg/g developer solids.

Three additional control samples were prepared as described above for Sample 1 with the following exceptions:

For Sample 2 (control), no Emphos® D70-30C was added but 0.06 g of DCAA was added to the diluted developer resulting in a concentration of DCAA of 4 mg/g developer solids.

For Sample 3 (control), 287.6 g of a copolymer of ethylene (91%) and methacrylic acid (9%), melt index at 190° C. is 500, acid No. is 54 and 1.28 g p-toluenesulfonic acid (pTSA) (Aldrich 99%) were added with the cyan pigment to the attritor. The concentration of pTSA was 4 mg/g toner solids.

Results are given in Table 4 below.

EXAMPLE 6

Five cyan developer samples were prepared as described above for Sample 1 in Control 6 with the following exceptions:

For Sample 4, the 10% Emphos® D70-30C charge director contained 0.5% dichloroacetic acid (Aldrich 99%) resulting in a concentration of DCAA of 4 mg/g developer solids;

For Sample 5, 0.06 gram of DCAA was added to the diluted charged developer resulting in a concentration of DCAA of 4 mg/g developer solids;

For Sample 6, the 10% Emphos® D70-30C was acidified by heating with 0.5% p-toluenesulfonic acid (pTSA) (Aldrich 99%), resulting in a concentration of pTSA of 4 mg/g developer solids.

For Sample 7, 0.06 gram of pTSA were added to the diluted charged developer resulting in a concentration of pTSA of 4 mg/g developer solids;

For Sample 8, 0.06 gram of pTSA were dissolved with heating in the Isopar®used to dilute the developer resulting in a concentration of pTSA of 4 mg/g developer solids and Emphos® D70-30C as described in Control 6, Sample 1 was added;

When the acids were dissolved in the charge director, mobility increased relative to the controls in which there was either no acid or no charge director. Although, the mobility of the examples did not increase relative to Control 3, the addition of the acid to the charge director has the advantage of increased formulation flexibility. Results are shown in Table 4 below.

TABLE 4

| SAMPLE | CONDUCTIVITY (pmho/cm) | MOBILITY ($\times 10^{10}$ $m^2/Vs$) |
|---|---|---|
| 1 (CONTROL) | 13 | 3.3 |
| 2 (CONTROL) | 0 | 1.9 |
| 3 (CONTROL) | 10 | 5.4 |
| 4 | 10 | 5.5 |
| 5 | 13 | 5.9 |
| 6 | 12 | 5.4 |
| 7 | 12 | 3.9 |
| 8 | 14 | 4.8 |

CONTROL 7

A cyan developer was prepared by adding 270 g of a copolymer of ethylene (89%) and methacrylic acid (11%), melt index at 190° C. is 100, acid No. is 66, 30 g of NBD 7010 (BASF) cyan pigment, and 1640 g of Isopar ®-L to a Union Process 1S Attritor, Union Process Company, Akron, Ohio charged with 0.1875 inch (4.76 mm) diameter carbon steel balls. The mixture was milled at 100° C. for one hour then cooled to ambient temperature and the mixture was milled for four hours. The particle size was 6.5 μm. The developer was diluted to 2% solids and charged as follows: 333 mg of Neutral Barium Petronate ® (NBP) (Witco Corp.) were added per gram of developer solids.

EXAMPLE 7

Developer was prepared as described in Control 7. In addition, dichloroacetic acid was added to the developer. Table 5 below gives the amount of dichloroacetic acid (DCAA) added (relative to NBP) and the resulting toner mobility. A significant improvement in toner mobility is seen even at the lowest level of dichloroacetic acid. Increased mobility is one of the primary factors in improving developer performance.

TABLE 5

| DEVELOPER | DCAA (%) | CONDUCTIVITY (pmho/cm) | MOBILITY ($\times 10^{10}$ $m^2/Vs$) |
|---|---|---|---|
| Cyan + NBP (control) | None | 200 | 2.0 |
| Cyan + NBP | 1% | 129 | 4.7 |
| Cyan + NBP | 3% | 176 | 6.3 |
| Cyan + NBP | 5% | 202 | 6.6 |
| Cyan + NBP | 7% | 237 | 7.0 |
| Cyan + NBP | 9% | 239 | 7.7 |
| Cyan + NBP | 15% | 235 | 6.5 |

CONTROL 8

The toner of Control 7 was diluted to 1.5% solids, charged with 100 mg of Neutral Barium Petronate ® per gram of developer solids was added to the developer.

Image quality was determined using Savin 870 with Plainwell Offset Enamel paper as described in Control 2 under positive toner test conditions:

charging corona set at +6.8 Kv, development bias set at +650 volts, and transfer corona set at −6.6 Kv, Reversal Image Target (black areas on target image with negative toner, white areas on target image with positive toner, gray areas are background). The mobility was measured on a Matec, Inc. Electrokinetic sonic amplitude instrument. Results are shown in Table 6 below.

EXAMPLE 8

A developer was prepared as described in Control 8 and to it was added 100 mg/g Neutral Barium Petronate ® (NBP) and 5 mg/g dichloroacetic acid (DCAA). Image quality was determined as in Control 8. Results are given in Table 6 below.

TABLE 6

| SAMPLE | ACID ADDITIVE | MOBILITY ($\times 10^{10}$ $m^2/Vs$) | RESOLUTION (lp/mm) | DENSITY |
|---|---|---|---|---|
| CONTROL 8 | None | 3.39 | 6 | 0.97 |
| EXAMPLE 8 | DCAA | 6.36 | 8 | 1.08 |

CONTROL 9

An unpigmented toner was prepared by adding 200 g of Elvacite ®2014 and 1700 g of Isopar ®-L to a Union Process 1S Attritor, Union Process Company, Akron, Ohio charged with 0.1875 inch (4.76 mm) diameter carbon steel balls. The mixture was milled at 100° C. for 1.5 hours then cooled to ambient temperature and the mixture was milled for 19.5 hours. The particle size was 6.5 μm.

The Elvacite ® developer was diluted to 2% solids and charged by addition of 120 mg/g Emphos ® D70-30C. Mobility of the developer was measured. Results are given in Table 7 below.

EXAMPLE 9

Developer was prepared as in Control 9 with the following exceptions: acidified charge directors were prepared by blending and heating acids with 10% Emphos ® D70-30C charge director. The acids and amounts added are given in the Table 7 below. The percentages are relative to Emphos ® solids. The Elvacite ® developer was charged by addition of 120 mg/g acidified Emphos ® .

Mobility of the developer was measured. Results are given in Table 7 below. Increased mobility is one of the primary factors in improving developer performance.

TABLE 7

| ADDITIVE | CONDUCTIVITY (pmhos/cm) | MOBILITY ($\times 10^{10}$ $m^2/Vs$) |
|---|---|---|
| None (control) | 34 | 3.0 |
| dichloroacetic acid (5%) | 36 | 6.7 |
| dinonylnaphthalene sulfonic acid (18%) | 32 | 3.4 |
| dinonylnaphthalene sulfonic acid (81%) | | 5.4 |
| p-nitrobenzoic acid (5%) | 42 | 6.5 |
| p-toluene sulfonic acid (5%) | 43 | 4.9 |
| phosphoric acid (5%) | 60 | 6.1 |

What is claimed is:

1. A process for preparing a positive electrostatic liquid developer comprising (A) dispersing at an elevated temperature in a vessel a thermoplastic resin and a nonpolar liquid having a Kauri-butanol value of less than 30, while maintaining the temperature in the vessel at a temperature sufficient to plasticize and liquify the resin and below that at which the nonpolar liquid degrades and the resin decomposes, (B) cooling the dispersion, either (1) without stirring to form a gel or solid mass, followed by shredding the gel or solid mass and grinding by means of particulate media;

(2) with stirring to form a viscous mixture and grinding by means of particulate media; or (3) while grinding by means of particulate media to prevent the formation of a gel or solid mass;

(C) separating the dispersion of toner particles having an average particle size of less than 30 μm from the particulate media, and (D) adding to the dispersion subsequent to Step (A) a nonpolar liquid soluble ionic or zwitterionic charge director compound mixed with an acid having a pKa of <4.2 and a solubility of at least 0.5% based on the weight of charge director compound in the mixture of nonpolar liquid and charge director compound.

2. A process according to claim 1 wherein the acid has a pKa of <3.5.

3. A process according to claim 1 wherein the acid has a pKa of <3.0.

4. A process according to claim 1 wherein the acid is selected from the group consisting of (1) inorganic acid compounds of the general formula:

$H_xY$ where x is an integer from 1–4 and is equal to the negative charges on the anion, Y is a moiety selected from the group consisting of $Cl^-$, $F^-$, $NO_3^-$, $NO_2^-$, $PO_4^{-3}$, $SO_4^{-2}$, $SO_3^{-2}$, $ClO_4^-$, and $IO_4^-$;

(2) organic acid compounds of the general formulas:

R—NH—SOhd 3H (i)

$R—SO_3H$ (ii)

$R—PO_3H_2$ (iii)

where R is alkyl of 1 to 30 carbon atoms, aryl of 6 to 30 carbon atoms, substituted alkyl of 1 to 30 carbon atoms, or substituted aryl of 6 to 30 carbon atoms; and (3) substituted carboxylic acid compounds of the general formula $X_y—R—CO_2H$ where R is alkyl of 1 to 500 carbon atoms, aryl of 6 to 30 carbon atoms, and alkylaryl of 7 to 40 carbon atoms;

X is selected from the group consisting of (1) an electron withdrawing group selected from the group consisting of CHO, CN, Cl, Br, I, F, $CF_3$, $CO_2H$, $COR^1$, $CO_2R^1$, $N(R^1)_3+$, $SO_2R^1$, $CONR_2^1$, $CONH_2$, $CONHR^1$, $SO_2OR^1$, $NO_2$ wherein $R^1$ is alkyl of 1 to 40 carbon atoms, aryl of 6 to 30 carbon atoms and alkylaryl of 6 to 30 carbon atoms at least one electron withdrawing group being located no further than 5 carbon atoms from the carbonyl carbon of the acid group;

(2) a carboxylate anion-stabilizing moiety attached to the carbon atom adjacent to the carbonyl carbon of the acid group when R is alkyl, e.g., OH, SH, $SR^1$, wherein $R^1$ is alkyl of 1 to 40 carbon atoms, aryl of 6 to 30 carbon atoms, and alkylaryl of 6 to 30 carbon atoms; and (3) a carboxylate anion-stabilizing moiety attached to the carbon atom ortho to the carbon atom attached to the carbonyl carbon of the acid group when R is aryl, e.g., OH, SH, $SR^1$, wherein $R^1$ is alkyl of 1 to 40 carbon atoms, aryl of 6 to 30 carbon atoms, and alkylaryl of 6 to 30 carbon atoms; and combinations of (1), (2) and (3); and y is an integer of 1 to 20.

5. A process according to claim 4 wherein the acid is butylsulfonic acid.

6. A process according to claim 4 wherein the acid is sulfuric acid.

7. A process according to claim 4 wherein the acid is p-nitrobenzoic acid.

8. A process according to claim 4 wherein the acid is p-toluenesulfonic acid.

9. A process according to claim 4 wherein the acid is dichloroacetic acid.

10. A process according to claim 4 wherein the acid is dinonylnaphthalene sulfonic acid.

11. A process according to claim 4 wherein the acid is phosphoric acid.

12. A process according to claim 1 wherein the thermoplastic resin is a copolymer of ethylene and an α,β-ethylenically unsaturated acid selected from the group consisting of acrylic acid and methacrylic acid.

13. A process according to claim 1 wherein the thermoplastic resin is a copolymer of ethylene (80 to 99.9%) and acrylic or methacrylic acid (0 to 20%)/alkyl $C_1$ to $C_5$ ester of acrylic or methacrylic acid (0 to 20%).

14. A process according to claim 13 wherein the thermoplastic resin is a copolymer of ethylene (89%) and methacrylic acid (11%) having a melt index at 190° C. of 100.

15. An electrostatic liquid developer according to claim 1 wherein the thermoplastic resin component is a copolymer of acrylic or methacrylic acid and at least one alkyl ester of acrylic or methacrylic acid wherein alkyl is 1 to 20 carbon atoms.

16. An electrostatic liquid developer according to claim 15 wherein the thermoplastic resin component is a copolymer of methyl methacrylate (50–90%)/methacrylic acid (0–20%)/ethyl hexyl acrylate (10–50%).

17. A process according to claim 1 wherein a colorant is added in Step (A).

18. A process according to claim 17 wherein the colorant is a pigment.

19. A process according to claim 17 wherein the colorant is a dye.

20. A process according to claim 1 wherein a fine particle size oxide is added in Step (A).

21. A process according to claim 20 wherein the fine particle size oxide is silica.

22. A process according to claim 1 wherein an adjuvant is present.

23. A process according to claim 22 wherein the adjuvant is selected from the group consisting of polyhydroxy compound, polybutylene succinimide, and an aromatic hydrocarbon.

24. A process according to claim 17 wherein an adjuvant is present during or subsequent to Step (A).

25. A process according to claim 24 wherein the adjuvant is selected from the group consisting of polyhydroxy compound, polybutylene succinimide, and an aromatic hydrocarbon.

26. A process according to claim 1 wherein the particles have an average particle size of less than 5 μm.

27. A process according to claim 1 wherein there is present in the vessel up to 100% by weight of a polar liquid having a Kauri-butanol value of at least 30, the percentage based on the total weight of the developer liquid.

28. A process according to claim 1 wherein the particulate media are selected from the group consisting of stainless steel, carbon steel, ceramic, alumina, zirconia, silica and sillimanite.

29. A process according to claim 1 wherein additional nonpolar liquid, polar liquid, or combinations thereof is present to reduce the concentration of toner particles to between 0.1 to 15 percent by weight with respect to the developer liquid.

30. A process according to claim 29 wherein the concentration of toner particles is reduced by additional nonpolar liquid.

* * * * *